US006432222B2

(12) United States Patent
Ohata et al.

(10) Patent No.: US 6,432,222 B2
(45) Date of Patent: Aug. 13, 2002

(54) METHOD FOR PRODUCING A GRAIN-ORIENTED ELECTRICAL STEEL SHEET EXCELLENT IN MAGNETIC PROPERTIES

(75) Inventors: Yoshifumi Ohata; Tomoji Kumano; Norikazu Fujii, all of Kitakyushu; Hisashi Mogi, Futtsu; Hitoshi Yokouchi; Norihiro Yamamoto, both of Kitakyushu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/873,963

(22) Filed: Jun. 4, 2001

(30) Foreign Application Priority Data

Jun. 5, 2000 (JP) ..... 2000-167963

(51) Int. Cl.[7] ..... H01F 1/147
(52) U.S. Cl. ..... 148/111; 148/113
(58) Field of Search ..... 148/110–113

(56) References Cited

U.S. PATENT DOCUMENTS

| | | | | | |
|---|---|---|---|---|---|
| 4,473,416 | A | * | 9/1984 | Kawano et al. | 148/111 |
| 4,979,996 | A | * | 12/1990 | Kobayashi et al. | 148/111 |
| 5,082,509 | A | * | 1/1992 | Ushigama et al. | 148/111 |
| 5,800,633 | A | * | 9/1998 | Inokuti | 148/111 |
| 5,855,694 | A | * | 1/1999 | Toge et al. | 148/111 |
| 5,885,371 | A | * | 3/1999 | Komatsubara et al. | 148/113 |

FOREIGN PATENT DOCUMENTS

| | | |
|---|---|---|
| JP | 59-56522 | 4/1984 |
| JP | 1-168817 | 7/1989 |
| JP | 2-182866 | 7/1990 |
| JP | 5-112827 | 5/1992 |
| JP | 5-295443 | 11/1993 |
| JP | 6-322433 | 11/1994 |
| JP | 9-118964 | 5/1997 |

OTHER PUBLICATIONS

Materials Science Forum, vols. 204–206, pp. 629–634, Prediction Method of Sharpness of 110 001 Secondary Recrystallization Texture of Fe–3%Si Alloy, Y. Yosyitomi, et al. 1996.

ISIJ, vol. 15, pp. 2049–2056, "Improvement of Magnetic Properties by Cu Addition in Grain–oriented Silicon Steel", Tomohiko Sakai, et al.

* cited by examiner

*Primary Examiner*—John Sheehan
(74) *Attorney, Agent, or Firm*—Kenyon & Kenyon

(57) ABSTRACT

A method for producing a grain-oriented electrical steel sheet excellent in magnetic property, comprising the steps of; heating a slab containing a prescribed amount of Al to a temperature of 1,200° C. or higher, hot-rolling the slab into a hot-rolled strip, annealing the strip as required, cold-rolling it once or twice or more with intermediate annealing (s), and decarburization annealing the cold rolled sheet, and final box annealing after the application of an annealing separator to prevent strip sticking during the annealing, characterized by heating the slab to a temperature (slab heating temperature Ts (° C.)) higher than the complete solution temperature of substances having intensities as inhibitors and nitriding treating the decarburization annealed steel sheet before the commencement of secondary recrystallization during the final box annealing.

7 Claims, 5 Drawing Sheets

| SYMBOL | ○ | △ | ▲ | × |
|---|---|---|---|---|
| $\Delta B_8$ (T) | 0.02 OR LESS | 0.04 OR LESS | OVER 0.04 | CONTAINING POOR SECONDARY RECRYSTALLIZATION |

| SYMBOL | ○ | △ | ▲ | × |
|---|---|---|---|---|
| $\Delta B_8$ (T) | 0.02 OR LESS | 0.04 OR LESS | OVER 0.04 | CONTAINING POOR SECONDARY RECRYSTALLIZATION |

| SYMBOL | ○ | △ | ▲ | × |
|---|---|---|---|---|
| $\Delta B_8$ (T) | 0.02 OR LESS | 0.04 OR LESS | OVER 0.04 | CONTAINING POOR SECONDARY RECRYSTALLIZATION |

| SYMBOL | ○ | △ | ▲ | × |
|---|---|---|---|---|
| $\Delta B_8$ (T) | 0.02 OR LESS | 0.04 OR LESS | OVER 0.04 | CONTAINING POOR SECONDARY RECRYSTALLIZATION |

| SYMBOL | ○ | △ | ▲ | × |
|---|---|---|---|---|
| $\Delta B_8$ (T) | 0.02 OR LESS | 0.04 OR LESS | OVER 0.04 | CONTAINING POOR SECONDARY RECRYSTALLIZATION |

METHOD FOR PRODUCING A GRAIN-ORIENTED ELECTRICAL STEEL SHEET EXCELLENT IN MAGNETIC PROPERTIES

BACKGROUND OF THE INVENTION

1. Field of the Invention

This invention relates to a method for producing a grain-oriented electrical steel sheet used mainly for iron cores of transformers and the like.

2. Description of the Related Art

Various technologies have been proposed for stably producing a grain-oriented electrical steel sheet having excellent magnetic properties with a magnetic flux density $B_8$ (magnetic flux density in a magnetic field of 800 A/m) exceeding 1.9 T. The technologies can be classified, generally, into the following three groups.

The first group of technologies consists of a method of heating a slab to an ultra high temperature of 1,350 to 1,450° C., at the maximum, and retaining the slab at the heating temperature for a period of time sufficient for heating (soaking) the entire slab. The object of this method is to change substances uniformly acting as inhibitors, such as MnS, AlN, etc., into complete solutions in order to activate them as inhibitors necessary for secondary recrystallization. Since the complete solution heat treatment is also effective as a measure to eliminate a difference in the intensity of the inhibitors in different parts of a slab, the above method is reasonable in this respect for realizing stable production of the products.

In the above method, however, the heating temperature necessary for the complete solution of substances having the inhibition capacity, or the complete solution temperature, is very high. Since the slab has to be heated, in actual production practices, to a temperature equal to or above the complete solution temperature (an ultra high temperature) in order to secure the amounts of inhibitors necessary for secondary recrystallization, the method involves various problems in actual production practice.

The problems include, for example, the following: ① it is difficult to secure a desired rolling temperature during hot rolling and, when the desired temperature is not achieved, poor secondary recrystallization occurs because inhibitor intensity becomes uneven in a slab; ② coarse grains form during the heating for hot rolling and the portions with the coarse grains fail to re-crystallize at the secondary recrystallization, leading to streaks; ③ slab surface layers melt into slag, which in turn requires a large amount of manpower for the maintenance of reheating furnaces; and ④ product yield decreases because huge edge cracks occur in the hot rolled steel strips.

As improvements to the first group technologies, methods intended to stabilize the secondary recrystallization by applying a nitriding treatment after primary recrystallization based on the above method are known, such as those disclosed in Japanese Unexamined Patent Publication No. H1-168817, etc. The problem this method can solve, however, is only the one described in ① above, and the solution of the problems in field production practices described in ② to ④ above still remains difficult.

The second group of technologies combine the use of AlN as an inhibitor, heating of a slab to below 1,280° C. and a nitriding treatment after a decarburization annealing and before the commencement of the secondary recrystallization, as disclosed in Japanese Unexamined Patent Publications Nos. S59-56522, H5-112827 and H9-118964, etc. In a method like the above, it is very important, to obtain a satisfactory secondary recrystallization, to control the mean size of primary recrystallization grains after the decarburization annealing within a prescribed range, usually 18 to 35 μm, as shown, for example, in Japanese Unexamined Patent Publication No. H2-182866.

Besides the above, Japanese Unexamined Patent Publication No. H5-295443 discloses a method to control the steel composition, etc., in order to minimize solute nitrogen, etc., at heating during hot rolling, for the purpose of homogenizing the size of the primary recrystallization grains in a coil, based on the fact that the solid solution amount in steel of the substances having the inhibition capacity such as solute nitrogen at heating during hot rolling, etc., determines the growth of the primary recrystallization grains.

By this method, although, however accurately controlled the steel composition may be, uneven distribution of the solute nitrogen, etc., remains in a slab, and it is impossible to eliminate, in the strict meaning of the word, the uneven distribution of the inhibition intensity, or that of the primary recrystallization grain size, within a coil. This results in a problem that it is sometimes difficult to obtain homogeneous secondary recrystallization within a coil (skid mark). Thus the above method is not an industrially stable production method.

The third group of technologies consist of a method to use $Cu_xS$ (x=1.8 or 2) as an inhibitor and heat a slab to a temperature equal to or above the complete solution temperature of $Cu_xS$ and equal to or below the complete solution temperature of MnS, as disclosed in Japanese Unexamined Patent Publication No. H6-322443, etc. The characteristics of this method lie in lowering the slab heating temperature and making additional process steps, such as the nitriding treatment employed in the second group of technologies, unnecessary.

This method, however, has a problem similar to the one involved in the second group of technologies (skid mark), because the slab heating temperature is equal to or below the complete solution temperature of MnS, and thus it is not an industrially stable production method, either. Besides, although $Cu_xS$ is widely known as an inhibitor to control the secondary recrystallization, it is inappropriate for the production of a grain-oriented electrical steel sheet having high magnetic flux density especially when a final cold rolling reduction ratio exceeds 80% (Tetsu-to-Hagané, p. 2049, No. 15, Vol. 70, 1984).

Generally speaking, whether or not it is possible to obtain a secondary recrystallization having good magnetic properties is determined mainly by the grain diameter of the primary recrystallization and secondary inhibitors to control the secondary recrystallization. While the grain diameter of the primary recrystallization by the first group technologies is about 10 μm, for example, the same by the second group technologies is 18 to 35 μm. The fact that it is possible to obtain a good secondary recrystallization by either the first or the second group of technologies, in spite of the fact that the diameter of the primary recrystallization grains is greatly different by the two groups of technologies as the examples above, indicates that the combination of the grain diameter of the primary recrystallization and the secondary inhibitors necessary to obtain a sharp Goss (the {110}<001> orientations) secondary recrystallization, is not unique.

In view of the above fact, the present inventors carried out a series of studies based on an idea that it was possible to obtain a sharp Goss secondary recrystallization by controlling the secondary inhibitors, regardless of the size of the primary recrystallization grains.

For the purpose of establishing a method to stably produce the product under the above facts, the present inventors classified the inhibitors indispensable for the production of a grain-oriented electrical steel sheet, by the process step where they function, into two groups, namely primary inhibitors to control the size of the primary recrystallization grains and secondary inhibitors to control that of the secondary recrystallization grains, and studied them in relation to the production of a grain-oriented electrical steel sheet having excellent magnetic properties.

It has to be noted here that, although it is true that the combination of the primary recrystallization grain size and the secondary inhibitors necessary, for obtaining a sharp Goss secondary recrystallization, is not uniquely defined, if the primary recrystallization grain size is different in different parts of a slab (coil), for example, a good orientation of the secondary recrystallization grains cannot be obtained unless the intensity of the secondary inhibitors is appropriately controlled in different portions of a coil. For this reason, a stable production method is defined as the one to provide a homogeneous grain size throughout the entire coil at both the primary and the secondary recrystallization.

It is also desirable that the intensity of the primary inhibitors be uniformly distributed throughout the entire slab, since the primary recrystallized grain size is determined by the intensity of the primary inhibitors and the temperature of a decarburization annealing during which the primary recrystallization takes place.

The most important point for establishing a stable production method of the product is, therefore, how to uniformly distribute both the primary and secondary inhibitors throughout a coil.

In this respect, the above first to third groups of technologies have the following problems, respectively:

In the first group technologies, it is very difficult to secure the inhibitor intensity necessary for the secondary recrystallization and, at the same time, realize stable product quality in an industrial production scale because, according to the technologies, it is necessary to heat a slab within an extremely narrow temperature range, namely the complete solution temperature of inhibitors or higher and a temperature below the temperature of forming coarse grains during the heating in hot rolling at which the secondary recrystallization becomes unstable without "pre-rolling process (break down)".

In the second group technologies, it is easy to secure the intensity of the secondary inhibitors by applying a nitriding treatment after the decarburization annealing and before the secondary recrystallization during final box annealing but, when viewed from the standpoint of the homogeneity of the primary inhibitor intensity, finite amounts of solute nitrogen and the like are distributed unevenly in different portions of a slab (coil), and this results in uneven grain size of the primary recrystallization grains. Further, in this case, the uneven distribution of the primary inhibitors within an entire slab (coil) leads to an uneven distribution of the secondary inhibitors, too, since the primary inhibitors function also as the secondary inhibitors.

The third group technologies are disadvantageous, similar to the second group technologies, in terms of uniform distribution of the primary inhibitors within a slab (coil), since no heat treatment is applied for complete solution of MnS, and 60% or more of AlN is made to precipitate after hot rolling. In the technologies, the secondary inhibitors are not changed from the primary inhibitors because no inhibitor intensifying treatment has been applied at any intermediate process and thus the secondary inhibitors are unevenly distributed in different portions of a coil. As a consequence, it is difficult by these technologies to secure stable product quality industrially. In addition, as explained before, although $Cu_xS$ is widely known as an inhibitor to control the secondary recrystallization, it is inappropriate for the production of a grain-oriented electrical steel sheet having high magnetic flux density especially with a final cold rolling reduction ratio exceeding 80%.

SUMMARY OF THE INVENTION

The object of the present invention, which was worked out in view of the above background, is to provide a method capable of very stably producing a grain-oriented electrical steel sheet having excellent magnetic properties by making the secondary recrystallization yet more complete.

The gist of the present invention is as described in (1) to (8) below.

(1) A method for producing a grain-oriented electrical steel sheet excellent in magnetic properties comprising the steps of; heating a slab containing a prescribed amount of Al to a temperature of 1,200° C. or higher, hot-rolling the slab into a hot rolled strip, optionally annealing the hot rolled strip, cold-rolling the hot rolled strip, in one stage or in two or more stages with intermediate annealing(s), and decarburization annealing the cold rolled sheet and final box annealing after the application of an annealing separator to prevent strip sticking during the annealing, characterized by heating the slab to a temperature (slab heating temperature Ts (° C.)) higher than the complete solution temperature of substances having capacities as inhibitors, and nitriding treating the decarburization annealed steel sheet before the commencement of secondary recrystallization during the final box annealing.

(2) A method for producing a grain-oriented electrical steel sheet excellent in magnetic properties according to item (1), characterized by heating the slab to a temperature of 1,350° C. or lower.

(3) A method for producing a grain-oriented electrical steel sheet excellent in magnetic properties according to item (1) or (2), characterized by using a slab comprising, in mass %:

0.025 to 0.10% of C, 2.5 to 4.0% of Si, 0.01 to 0.10% of acid-soluble Al (sAl), 0.0075% or less of N, 0.003 to 0.05% of Seq (=S+0.406×Se), and 0.02 to 0.20% of Mn, and the balance consisting of Fe and unavoidable impurities, and heating the slab to a slab heating temperature Ts (° C.) higher than any of $T_1$ (° C.), $T_2$ (° C.) and $T_3$ (° C.) defined by the following equations, respectively, where indicates the mass % of the component element written[ ] inside the [ ];

$$T_1=10{,}062/(2.72-\log([sAl]*[N]))-273$$

$$T_2=14{,}855/(6.82-\log([Mn]*[S]))-273$$

$$T_3=10{,}733/(4.08-\log([Mn]*[Se]))-273.$$

(4) A method for producing a grain-oriented electrical steel sheet excellent in magnetic properties according to any one of items (1) to (3), characterized by using the slab comprising, additionally, 0.01 to 0.30 mass % of Cu, and heating the slab to a slab heating temperature Ts (° C.) higher than $T_4$ (° C.) defined by the following equation, where [ ] indicates the mass % of the component element written inside the [ ];

$$T_4=43{,}091/(25.09-\log([Cu]*[Cu]*[S]))-273.$$

(5) A method for producing a grain-oriented electrical steel sheet excellent in magnetic properties according to any one of items (1) to (4), characterized by using the slab comprising, additionally, 0.0005 to 0.0060 mass % of B, and heating the slab to a slab heating temperature Ts (° C.) higher than $T_5$ (° C.) defined by the following equation, where [ ] indicates the mass % of the component element written inside the [ ];

$$T_5=13{,}680/(4.63-\log([B]*[N]))-273.$$

(6) A method for producing a grain-oriented electrical steel sheet excellent in magnetic properties according to any one of items (1) to (5), characterized in that the mean diameter of primary recrystallization grains after the decarburization annealing is 7 $\mu$m or more and below 18 $\mu$m.

(7) A method for producing a grain-oriented electrical steel sheet excellent in magnetic properties according to any one of items (1) to (6), characterized by controlling the increment of nitrogen in the steel sheet to 0.001 to 0.03 mass % by applying the nitriding treatment to the steel strip while it is running in an atmosphere of a mixed gas of hydrogen, nitrogen and ammonia.

(8) A method for producing a grain-oriented electrical steel sheet excellent in magnetic properties according to any one of items (1) to (7), characterized by controlling the cold rolling reduction ratio at the final cold rolling before the decarburization annealing to 80% or more and 95% or less.

DESCRIPTION OF THE PREFERRED EMBODIMENTS

Figure 1:
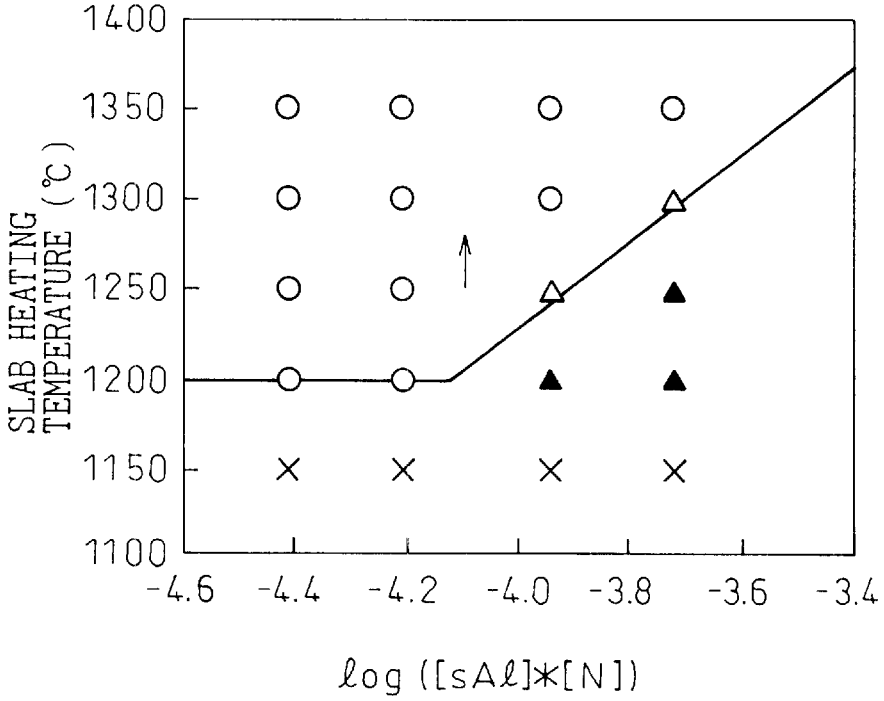
FIG. 1 is a graph showing the relationship between the content of sAl and N, slab heating temperature and the deviation of $B_8$ within a product coil.

Starting from a concept that the best method to homogenize the distribution of primary inhibitors within a slab (coil) to the maximum possible extent was to change the substances having intensities as inhibitors into complete solution during slab heating, the present inventors directed their attention to the phenomenon that the complete solution temperature of the substances having the inhibitor intensities lowered when their contents in a slab were made lower than in conventional methods. The technologies to completely dissolve the inhibitors during heating for hot rolling include the first group technologies, but they were not viable as stable industrial production technologies, since secondary recrystallization was made unstable, by them, when the contents of the substances having the inhibitor intensities in a slab were lowered.

Facing this situation, the present inventors clarified, as a result of assiduous studies and experiments, that, if the content of nitrogen in the chemical composition of a slab was high, it was difficult to uniformly distribute the primary inhibitors throughout the entire slab even when the slab was heated at the complete solution temperature or above, that is, the key point to drastically minimize the unevenness of primary inhibitor capacity within a slab was to decrease the concentration of nitrogen in the slab chemical composition.

With regard to sulfide and selenide inhibitors, on the other hand, it was made clear that they did not have as much influence the homogenization of inhibitors at the hot rolling process as the nitride inhibitors did, and the present inventors discovered that it was effective to use mainly sulfide and selenide inhibitors as the primary inhibitors.

The reason for the difference in the effect between the nitride inhibitors and the sulfide and selenide inhibitors is not clear, but it is presumably because, owing to the fact that the solubility of AlN is greatly different between an $\alpha$ phase and a $\gamma$ phase, AlN precipitates unevenly when the $\gamma$ phase, where AlN dissolves well, in the matrix phase changes to the $\alpha$ phase, where it does not, during hot rolling.

It is possible to make the unevenness of the primary inhibitor intensity within a slab (coil) extremely small by the above measure (decreasing the nitrogen content in the slab chemical composition). To obtain a Goss orientation well aligned in a direction to show excellent magnetic properties at the secondary recrystallization, however, an inhibitor remaining stable at a high temperature is required in addition to the sulfide and selenide inhibitors. In the present invention, this additional inhibitor is secured by forming AlN through a nitriding treatment.

In other words, the present invention enables stable production of a grain-oriented electrical steel sheet excellent in magnetic properties by: lowering the complete solution temperature of inhibitors through making the contents of the substances having intensities as inhibitors in the slab chemical composition lower than in conventional methods; homogenizing the intensity of the primary inhibitors throughout a slab through heating the slab at a temperature higher than the lowered complete solution temperature; and compensating for the insufficiency of the secondary inhibitor intensity caused by the lowered contents of the inhibitors through the nitriding treatment after the decarburization annealing and before the commencement of the secondary recrystallization during the final box annealing so that nitrides (single or compound precipitates of AlN, $Si_3N_4$ and MnS, etc.) may form and function as inhibitors.

In summary, the object of the present invention is to provide a very stable method for producing the product by metallurgically dividing the functioning stages of the inhibitors, which have significant roles in the production of a grain-oriented electrical steel sheet, and making different inhibitor substances function at different stages.

In the production of a grain-oriented electrical steel sheet, the temperature of the decarburization annealing where the primary recrystallization takes place is generally low, 930° C. or lower, and, for this reason, strong inhibitors such as those formed at the high temperature hot rolling of conventional methods are not required at this stage. Since the present invention mainly employs sulfides and selenides as the primary inhibitors, the temperature-dependency of grain growth in the primary recrystallization is extremely small and, therefore, it is not necessary to significantly change the temperature at a primary recrystallization annealing (the decarburization annealing, in actual practice). As a result, the structure and composition of a oxide film formed in decarburizing annealing and the nitride amount at the subsequent nitriding treatment are greatly stabilized, and glass film defects are drastically decreased.

Hereafter, the reasons for limiting the slab chemical composition in the present invention are described.

When the content of C is less than 0.025%, the primary recrystallization texture becomes inappropriate and, when it exceeds 0.10%, it is difficult to decarburize and that does not suit industrial production.

When the content of Si is less than 2.5%, a good core loss value is not obtained and, when it exceeds 4.0%, it is extremely difficult to cold-roll and that does not suit industrial production.

Al combines with N to form AlN, which functions mainly as a secondary inhibitor. The AlN is formed both before the nitriding treatment and during a high temperature annealing after the nitriding and, to secure a sufficient amount of AlN formed at the both stages, an Al content of 0.01 to 0.10% is required. When the Al content is below 0.01%, the effect of AlN as a secondary inhibitor is insufficient, making it impossible to stably obtain secondary recrystallization grains with sharp Goss orientation and, when it exceeds 0.10%, the amount of nitrides required at a later process stage increases, causing great damage to a glass film.

The upper limit of the amount of N is set at 0.0075% since its content exceeding 0.0075% causes uneven precipitation during hot rolling. A more preferable upper limit is 0.0050%.

S and Se combine with Mn and Cu and function mainly as the primary inhibitors. The contents of S and Se are controlled using Seq (=S+0.406×Se) as an indicator. When Seq exceeds 0.05%, the time required for purification at the final box annealing becomes unfavorably long and, when it is below 0.003%, their effects as the primary inhibitors are not enough. Therefore, the lower limit of Seq has to be set at 0.003%.

When the content of Mn is lower than 0.02%, cracks are likely to occur to hot rolled strips, causing product yield to decrease. When it exceeds 0.20%, on the other hand, the amounts of MnS and MnSe become so large that their solid solution becomes locally uneven and stable production is made difficult. Hence, its upper limit is set at 0.2%.

When a slab is hot rolled under the condition of the present invention to heat it to 1,200° C. or higher, Cu combines with S and Se to form fine precipitates, which function as primary inhibitors. The precipitates function also as nuclei of AlN precipitation making the distribution of AlN more even, besides acting as a secondary inhibitor, and these effects bring about good secondary recrystallization. When the content of Cu is less than 0.01%, the above effects are decreased and stable production is jeopardized. When it exceeds 0.30%, the effects become saturated, and surface defects called copper scabs are caused during hot rolling.

When the content of B is less than 0.0005%, its inhibition effect in the form of BN does not appear but, when the content exceeds 0.006%, the amount of N required for forming inhibitors by nitriding becomes too large, causing a frequent occurrence of glass film defects where matrix steel surface is exposed (bare spots).

Further, with regard to the contents of Al, N, S, Se, Mn, Cu and B, when any one of $T_1$ (° C.) to $T_5$ (° C.), calculated from the chemical compositions of the slab according to the equations below, is 1,400° C. or higher, it becomes necessary to make the slab heating temperature Ts (° C.) very high in order to dissolute these elements completely. For avoiding such an undesirably high heating temperature, their contents have to be controlled in relation with each other;

$$T_1=10{,}062/(2.72-\log([sAl]*[N]))-273$$

$$T_2=14{,}855/(6.82-\log([Mn]*[S]))-273$$

$$T_3=10{,}733/(4.08-\log([Mn]*[Se]))-273$$

$$T_4=43{,}091/(25.09-\log([Cu]*[Cu]*[S]))-273$$

$$T_5=13{,}680/(4.63-\log([B]*[N]))-273,$$

where [ ] indicates the mass % of the component element written inside the [ ].

As stated before, the present invention controls primary recrystallization grains using mainly sulfides and selenides as primary inhibitors, and it is necessary to minimize the amount of N content in the slab, preferably to 0.0050% or less. This alone, however, is not enough for controlling the secondary recrystallization, and a nitriding treatment described later is required.

It has to be noted that, in addition to Al, N, S, Se, Mn, Cu and B mentioned above, Sn, Sb, P, Cr, Mo, Cd, Ge, Te and Bi, etc. are also suitable as elements forming inhibitor, and since Ni is remarkably effective for evenly distributing the precipitates functioning as the primary and secondary inhibitors, small amounts of these elements may be added to steel in combination with the others.

Appropriate addition amounts of these elements are: 0.02 to 0.3% for each of Sn, Sb, P and Cr; 0.008 to 0.3% for each of Mo and Cd; 0.005 to 0.1% for each of Ge, Te and Bi; and 0.03 to 0.3% for Ni. Each of them may be added singly or in combination with the others.

Next, the reasons for limiting the conditions of production processes in the present invention are described hereafter.

According to Japanese Unexamined Patent Publication No. H7-252532, for example, the mean size of primary recrystallization grains after the completion of the decarburization annealing is 18 to 35 μm. By the present invention, however, it is possible to further improve the magnetic properties (especially the core loss) by controlling the mean diameter of the primary recrystallization grains to 7 μm or more and below 18 μm.

That means that the smaller the size of the primary recrystallization grains is, the larger the number of primary recrystallization grains, existing in a unit volume, is. Further, from the viewpoint of grain growth, when the size of the primary recrystallization grains is small, the volume fraction of Goss orientation grains, which serve as nuclei for the secondary recrystallization, increases at the primary recrystallization stage (Materials Science Forum Vol. 204–206, Part 2: pp: 631).

As a result, the absolute number of the Goss orientation grains increases, for example, by as much as five times that in the case of a mean size of the primary recrystallization grains being 18 to 35 μm. This also leads to a relatively smaller grain size of the secondary recrystallization grains, resulting in a remarkable improvement of the core loss.

In addition, when the mean size of the primary recrystallization grains is small, the driving force of the secondary recrystallization increases, and it is possible to make the secondary recrystallization begin at an earlier stage of heating (at a lower temperature) in the final box annealing. In the present practice where the final box annealing is applied to steel sheets in coils, the higher the annealing temperature is, the larger the temperature difference (difference in thermal hysteresis) in different portions of a coil becomes. For this reason, the decrease in the secondary recrystallization temperature enables the secondary recrystallization to take place at a temperature range where the thermal hysteresis is more even at different portions of a coil (heating rate is more even throughout a coil), and the magnetic properties of the product are stabilized due to a drastically decreased unevenness in different portions of a coil.

When the mean size of the primary recrystallization grains is below 7 $\mu$m, however, deviation of the orientations of the secondary recrystallization grains from the Goss orientation becomes large and the magnetic flux density deteriorates, presumably because the secondary recrystallization temperature becomes too low owing to a large driving force of grain growth of the small primary recrystallization grains.

The nitriding treatment of the steel sheet after the decarburization annealing and before the commencement of the secondary recrystallization is essential in the present invention. The methods include a method of mixing nitrides (CrN, MnN, etc.) into an annealing separator for the final box annealing and a method of applying a nitriding treatment to a travelling steel strip after the decarburization annealing in an ammonia-containing atmosphere. Either of the two methods is applicable, but the latter is industrially more preferable and controllable.

The amount of nitrogen added to the steel sheet (nitrogen increment) at the nitriding treatment is limited to 0.001 to 0.03 mass %. When it is below 0.001%, the secondary recrystallization becomes unstable and, when it exceeds 0.03%, on the other hand, defects in the glass film, where matrix steel is exposed, occur frequently. A more preferable nitrogen increment is 0.003 to 0.025%.

The temperature of slab heating prior to hot rolling is an important point in the present invention. When the slab heating temperature is below 1,200° C., the formation of the primary inhibitors, one of the key points of the present invention, is insufficient, causing problems in that, for example, the primary recrystallization grain size depends on the temperature of the decarburization annealing much more.

It is also possible to drastically decrease the difference in the primary inhibitor intensity in different portions of a slab by raising the slab heating temperature above the complete solution temperature of the substances having the inhibitor intensity. When the slab heating temperature is set just above the complete solution temperature of the inhibitors, however, it is necessary to retain the slab at the heating temperature for a longer time to make the inhibitors change into solid solutions. It is therefore desirable, from a productivity viewpoint, to set the heating temperature higher than the complete solution temperature by at least about 20° C. Note that heating a slab at an ultra high temperature above 1,350° C. should be avoided since it involves great difficulty in industrial production. A practically preferable slab heating temperature is 1,200 to 1,350° C., since hot rolling is easy, a good hot strip shape (crown) is obtainable, and no problems related to melting of slab surface layers into slag occur in this temperature range.

By the production method according to the present invention, a slab of an initial thickness of 100 to 300 mm, preferably 200 to 250 mm, is cast by a well-known continuous casting process. A so-called thin slab of an initial thickness of about 30 to 100 mm can also be used in place of the thick slab. The thin slab has an advantage that rough rolling to an intermediate thickness is not necessary in producing a hot rolled strip. Further, it is also possible to produce a grain-oriented electrical steel sheet by the present invention using a slab or a strip of a yet smaller initial thickness cast by a strip casting process.

In industrial production practice, a ordinary gas heating method is applicable for heating the slab for hot rolling. It is desirable for homogeneous annealing to apply induction heating or direct electric resistance heating in addition to the gas heating and, when such a special heating method is employed, there is no problem in applying a breakdown rolling to a cast slab for obtaining a desired dimension. Besides, when the heating temperature is 1,300° C. or higher, it is also viable to reduce the content of C by applying the breakdown rolling for improving the texture. These practices are included in conventional technologies.

When the final cold rolling reduction ratio of cold rolling is below 80%, the Goss orientation grains in the primary recrystallization texture have large distributions from just Goss orientation and, thus, it is difficult to secure a high magnetic flux density. When the final cold rolling reduction ratio exceeds 95%, on the other hand, the number of the Goss orientation grains in the primary recrystallization texture decreases drastically. The secondary recrystallization becomes unstable as a result.

A hot-rolled strip is annealed mainly for the purpose of eliminating unevenness in structure and inhibitor distribution that occurs within a strip during hot rolling. The annealing for this purpose can be done at a stage of either a hot-rolled strip or a strip before the final cold rolling. In other words, this annealing treatment is desirable to apply once or more times before the final cold rolling to eliminate the unevenness caused by an inhomogeneous thermal hysteresis during hot rolling.

The final cold rolling may be done at room temperature. However, when at least one pass of the final cold rolling is done at a temperature of 100 to 300° C. and then the rolled strip is retained at the temperature for 1 min. or more, the primary recrystallization texture is improved, resulting in excellent magnetic properties.

EXAMPLE 1

Slabs of chemical compositions (1) to (4) shown in Table 1 were manufactured into electrical steel sheets in the following sequential process steps: soaking for 60 min. at one of the following five different temperatures, namely (a) 1,150° C., (b) 1,200° C., (c) 1,250° C., (d) 1,300° C. and (e) 1,350° C.; hot rolling into strips of 2.0 mm in thickness; hot strip annealing by holding at 1,120° C. for 200 sec., holding at 900° C. immediately after that and then cooling rapidly; pickling; cold rolling to the thickness of 0.23 mm by holding the sheet at 180 - 220° C. for not less than 2 min in at least two passes; decarburization annealing by holding at 850° C. for 150 sec.; nitriding annealing by holding at 750° C. for 30 sec. in a mixed gas of hydrogen, nitrogen and ammonia to adjust the total nitrogen amount of the steel sheets after the nitriding to 200 ppm or so; application of an annealing separator, composed mainly of MgO and $TiO_2$, to prevent sticking during annealing; final box annealing by heating to 1,200° C. at a heating rate of 15° C./h. and holding at 1,200° C. for 20 h; and stress relief annealing. Then, after applying a tension coating mainly composed of colloidal silica and aluminum phosphate to the steel sheets thus produced, their magnetic properties were measured. Table 2 shows the magnetic property measurement results, etc. under the above test conditions and FIG. 1 shows the relationship of the contents of sAl and N and slab heating temperature to the deviation of $B_8$ within a product coil. It can be seen in the tables and the figure that excellent magnetic properties were stably obtained throughout the length of the product coils when they were produced from slabs with the chemical composition according to the present invention and under the process conditions specified in the present invention. [Table 1]

TABLE 1

| | Chemical composition (mass %) | | | | | | | | | | | Temperature (° C.) | | | | |
|---|---|---|---|---|---|---|---|---|---|---|---|---|---|---|---|---|
| No. | C | Si | sAl | N | S | Mn | Cu | Sn | P | Cr | Cd | $T_1$ | $T_2$ | $T_3$ | $T_4$ | $T_5$ |
| (1) | 0.055 | 3.24 | 0.026 | 0.0015 | 0.005 | 0.04 | 0.02 | 0.08 | 0.02 | 0.10 | 0.023 | 1138 | 1139 | — | 1127 | — |
| (2) | " | " | " | 0.0024 | " | " | " | " | " | " | " | 1180 | " | — | " | — |
| (3) | " | " | " | 0.0044 | " | " | " | " | " | " | " | 1237 | " | — | " | — |
| (4) | " | " | " | 0.0073 | " | " | " | " | " | " | " | 1289 | " | — | " | — |

TABLE 2

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 1 | (1) | a | 26.3 | No secondary recrystallization | — | Comparative example |
| 2 | (1) | b | 17.5 | 1.92–1.92 | 0.00 | Invention example |
| 3 | (1) | c | 17.4 | 1.92–1.93 | 0.01 | Invention example |
| 4 | (1) | d | 17.5 | 1.92–1.93 | 0.01 | Invention example |
| 5 | (1) | e | 17.6 | 1.92–1.93 | 0.01 | Invention example |
| 6 | (2) | a | 25.8 | No secondary recrystallization | — | Comparative example |
| 7 | (2) | b | 16.1 | 1.92–1.93 | 0.01 | Invention example |
| 8 | (2) | c | 16.1 | 1.93–1.94 | 0.01 | Invention example |
| 9 | (2) | d | 16.2 | 1.92–1.94 | 0.02 | Invention example |
| 10 | (2) | e | 15.9 | 1.93–1.94 | 0.01 | Invention example |
| 11 | (3) | a | 26.2 | No secondary recrystallization | — | Comparative example |
| 12 | (3) | b | 15.9 | 1.88–1.94 | 0.06 | Comparative example |
| 13 | (3) | c | 13.3 | 1.92–1.95 | 0.03 | Invention example |
| 14 | (3) | d | 13.3 | 1.95–1.95 | 0.00 | Invention example |
| 15 | (3) | e | 13.3 | 1.94–1.95 | 0.01 | Invention example |
| 16 | (4) | a | 25.9 | No secondary recrystallization | — | Comparative example |
| 17 | (4) | b | 16.2 | 1.84–1.95 | 0.11 | Comparative example |
| 18 | (4) | c | 13.2 | 1.88–1.95 | 0.07 | Comparative example |
| 19 | (4) | d | 12.0 | 1.92–1.95 | 0.03 | Invention example |
| 20 | (4) | e | 11.9 | 1.92–1.94 | 0.02 | Invention example |

EXAMPLE 2

Figure 2:
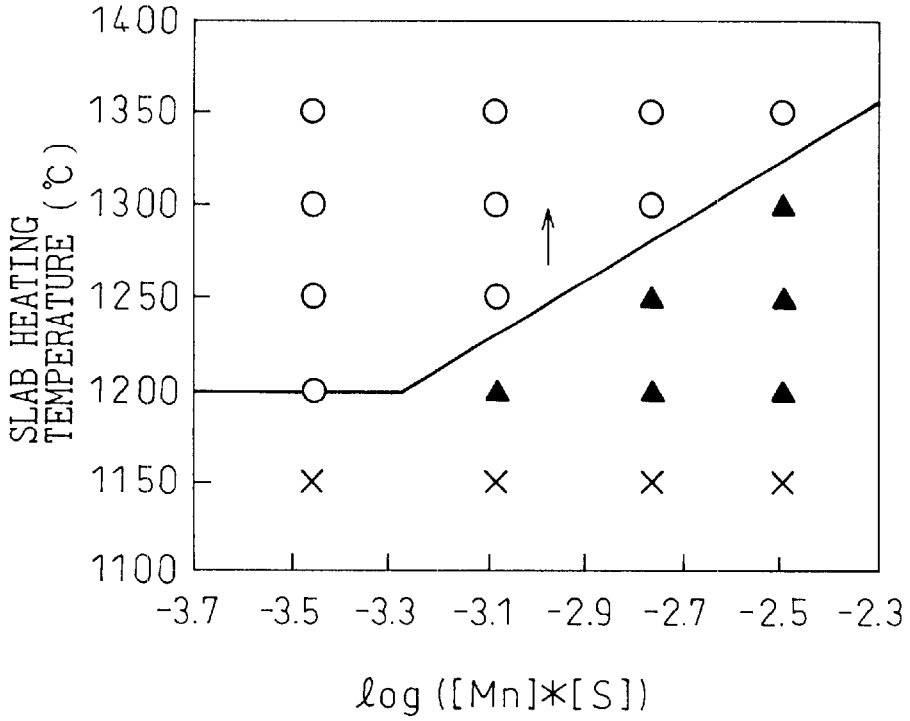
FIG. 2 is a graph showing the relationship between the content of Mn and S, slab heating temperature and the deviation of $B_8$ within a product coil.

Slabs of chemical compositions (5) to (8) shown in Table 3 were manufactured into electrical steel sheets in the following sequential process steps: soaking for 60 min. at one of the five temperatures of example 1; hot rolling into strips of 2.3 mm in thickness; hot strip annealing by holding at 1,120° C. for 180 sec., holding at 900° C. immediately after that and then cooling rapidly; pickling; cold rolling to the thickness of 0.30 mm with same aging treatment as Example 1; decarburization annealing by holding at 850° C. for 150 sec.; nitriding annealing by holding at 750° C. for 30 sec. in a mixed gas of hydrogen, nitrogen and ammonia to adjust the total nitrogen amount of the steel sheets after the nitriding to 200 ppm or so; application of an annealing separator, composed mainly of MgO and $TiO_2$, to prevent sticking during annealing; final box annealing by heating to 1,200° C. at a heating rate of 15° C./h. and then holding at 1,200° C. for 20 h; and stress relieving annealing. Then, after applying a tension coating mainly composed of colloidal silica and aluminum phosphate to the steel sheets thus produced, their magnetic properties were measured. Table 4 shows the magnetic property measurement results, etc. under the above test conditions and FIG. 2 shows the relationship of the contents of Mn and S and slab heating temperature to the deviation of $B_8$ within a product coil. It can be seen in the tables and the figure that excellent magnetic properties were stably obtained throughout the length of the product coils when they were produced from slabs with the chemical composition according to the present invention and under the process conditions specified in the present invention. In particular, when the mean grain diameter of the primary recrystallization is 7 to 18 $\mu$m, particularly good magnetic properties, where $B_8$ was 1.92 T, or more were stably obtained throughout the length of the product coils. [Table 3]

TABLE 3

| | Chemical composition (mass %) | | | | | | | | | | | | | Temperature (° C.) | | | | |
|---|---|---|---|---|---|---|---|---|---|---|---|---|---|---|---|---|---|---|
| No. | C | Si | sAl | N | S | Mn | Cu | Sn | Sb | P | Cr | Mo | Ge | $T_1$ | $T_2$ | $T_3$ | $T_4$ | $T_5$ |
| (5) | 0.060 | 3.30 | 0.023 | 0.0018 | 0.005 | 0.07 | 0.01 | 0.06 | 0.05 | 0.03 | 0.08 | 0.031 | 0.011 | 1144 | 1173 | — | 1100 | — |
| (6) | " | " | " | " | 0.012 | " | " | " | " | " | " | " | " | " | 1228 | — | 1117 | — |
| (7) | " | " | " | " | 0.025 | " | " | " | " | " | " | " | " | " | 1278 | — | 1131 | — |
| (8) | " | " | " | " | 0.046 | " | " | " | " | " | " | " | " | " | 1322 | — | 1143 | — |

TABLE 4

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 1 | (5) | a | 22.3 | Partially no secondary recrystallization | — | Comparative example |
| 2 | (5) | b | 20.0 | 1.88–1.89 | 0.01 | Invention example |
| 3 | (5) | c | 19.8 | 1.88–1.90 | 0.02 | Invention example |
| 4 | (5) | d | 19.7 | 1.89–1.90 | 0.01 | Invention example |
| 5 | (5) | e | 19.9 | 1.88–1.90 | 0.02 | Invention example |
| 6 | (6) | a | 22.2 | Partially no secondary recrystallization | — | Comparative example |
| 7 | (6) | b | 18.1 | 1.85–1.92 | 0.07 | Comparative example |
| 8 | (6) | c | 12.5 | 1.92–1.95 | 0.02 | Invention example |
| 9 | (6) | d | 12.2 | 1.93–1.95 | 0.02 | Invention example |
| 10 | (6) | e | 12.2 | 1.94–1.95 | 0.01 | Invention example |
| 11 | (7) | a | 22.5 | Partially no secondary recrystallization | — | Comparative example |
| 12 | (7) | b | 18.1 | 1.80–1.92 | 0.12 | Comparative example |
| 13 | (7) | c | 11.6 | 1.88–1.94 | 0.06 | Comparative example |
| 14 | (7) | d | 9.4 | 1.94–1.95 | 0.01 | Invention example |
| 15 | (7) | e | 9.6 | 1.95–1.95 | 0.00 | Invention example |
| 16 | (8) | a | 22.6 | Partially no secondary recrystallization | — | Comparative example |
| 17 | (8) | b | 17.9 | 1.86–1.93 | 0.07 | Comparative example |
| 18 | (8) | c | 11.4 | 1.85–1.95 | 0.10 | Comparative example |
| 19 | (8) | d | 9.5 | 1.90–1.95 | 0.05 | Comparative example |
| 20 | (8) | e | 6.5 | 1.88–1.89 | 0.01 | Invention example |

EXAMPLE 3

Figure 3:
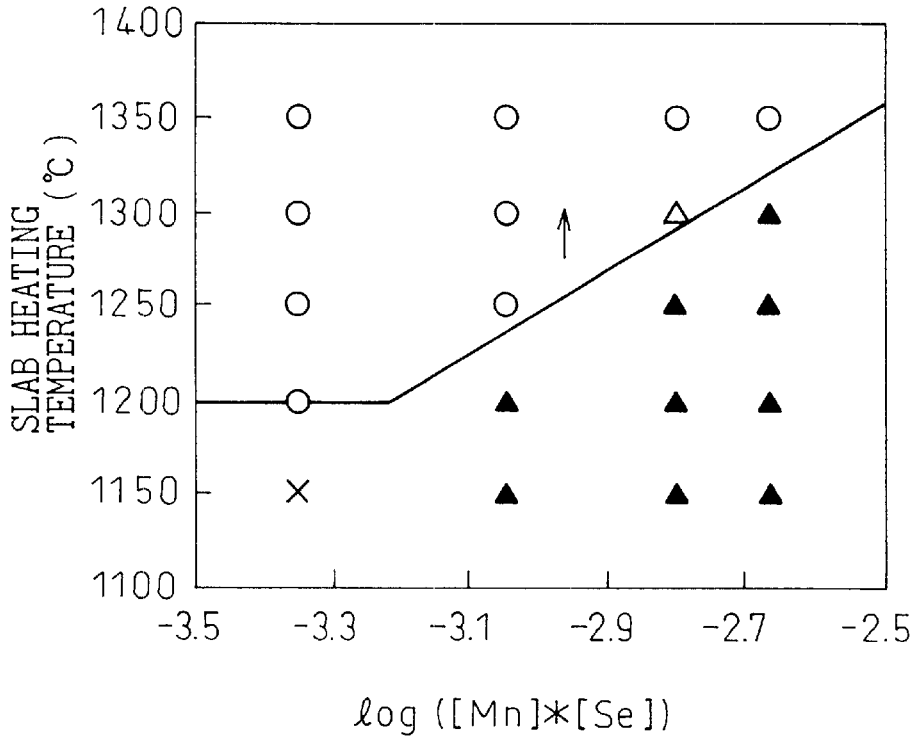
FIG. 3 is a graph showing the relationship between the content of Mn and Se, slab heating temperature and the deviation of $B_8$ within a product coil.

Slabs of chemical compositions (9) to (12) shown in Table 5 were manufactured into electrical steel sheets in the following sequential process steps: soaking for 60 min. at one of the five temperatures of example 1; hot rolling into strips of 2.5 mm in thickness; hot strip annealing by holding at 1,120° C. for 30 sec., holding at 900° C. immediately after that and then cooling rapidly; pickling; cold rolling to the thickness of 0.27 mm with same aging treatment as Example 1; decarburization annealing by holding at 850° C. for 90 sec.; nitriding annealing by holding at 750° C. for 30 sec. in a mixed gas of hydrogen, nitrogen and ammonia to adjust the total nitrogen amount of the steel sheets after the nitriding to 200 ppm or so; application of an annealing separator composed mainly of MgO and $TiO_2$ to prevent sticking during annealing; final box annealing by heating to 1,200° C. at a heating rate of 15° C./h. and holding at 1,200° C. for 20 h; and stress relieving annealing. Then, after applying a tension coating mainly composed of colloidal silica and aluminum phosphate to the steel sheets thus produced, their magnetic properties were measured. Table 6 shows the magnetic property measurement results, etc. under the above test conditions and FIG. 3 shows the relationship of the contents of Mn and Se and slab heating temperature to the deviation of $B_8$ within a product coil. It can be seen in the tables and the figure that excellent magnetic properties were stably obtained throughout the length of the product coils when they were produced from slabs of the chemical composition according to the present invention and under the process conditions specified in the present invention. [Table 5]

TABLE 5

| | Chemical composition (mass %) | | | | | | | | | | | | | Temperature (° C.) | | | | |
|---|---|---|---|---|---|---|---|---|---|---|---|---|---|---|---|---|---|---|
| No. | C | Si | sAl | N | S | Se | Mn | Cu | Sn | Sb | P | Cr | Bi | $T_1$ | $T_2$ | $T_3$ | $T_4$ | $T_5$ |
| (9) | 0.040 | 3.10 | 0.021 | 0.0027 | 0.005 | 0.009 | 0.05 | 0.01 | 0.06 | 0.03 | 0.03 | 0.08 | 0.018 | 1171 | 1152 | 1172 | 1100 | — |
| (10) | " | " | " | " | " | 0.018 | " | " | " | " | " | " | " | " | " | 1233 | " | — |
| (11) | " | " | " | " | " | 0.032 | " | " | " | " | " | " | " | " | " | 1288 | " | — |
| (12) | " | " | " | " | " | 0.043 | " | " | " | " | " | " | " | " | " | 1318 | " | — |

TABLE 6

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 1 | (9) | a | 22.3 | Partially no secondary recrystallization | — | Comparative example |
| 2 | (9) | b | 14.7 | 1.92–1.93 | 0.01 | Invention example |
| 3 | (9) | c | 14.9 | 1.92–1.93 | 0.01 | Invention example |
| 4 | (9) | d | 14.5 | 1.92–1.93 | 0.01 | Invention example |
| 5 | (9) | e | 14.7 | 1.92–1.94 | 0.02 | Invention example |
| 6 | (10) | a | 20.3 | 1.84–1.90 | 0.06 | Comparative example |
| 7 | (10) | b | 14.3 | 1.87–1.92 | 0.05 | Comparative example |
| 8 | (10) | c | 13.8 | 1.92–1.94 | 0.02 | Invention example |
| 9 | (10) | d | 13.6 | 1.94–1.95 | 0.01 | Invention example |
| 10 | (10) | e | 13.4 | 1.93–1.95 | 0.02 | Invention example |
| 11 | (11) | a | 20.4 | 1.82–1.90 | 0.08 | Comparative example |
| 12 | (11) | b | 15.0 | 1.82–1.92 | 0.10 | Comparative example |
| 13 | (11) | c | 13.5 | 1.85–1.91 | 0.06 | Comparative example |
| 14 | (11) | d | 12.5 | 1.92–1.95 | 0.03 | Invention example |
| 15 | (11) | e | 12.6 | 1.93–1.94 | 0.01 | Invention example |
| 16 | (12) | a | 20.3 | 1.83–1.89 | 0.06 | Comparative example |
| 17 | (12) | b | 14.9 | 1.81–1.92 | 0.11 | Comparative example |

TABLE 6-continued

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 18 | (12) | c | 13.4 | 1.83–1.95 | 0.12 | Comparative example |
| 19 | (12) | d | 10.7 | 1.90–1.95 | 0.05 | Comparative example |
| 20 | (12) | e | 11.1 | 1.95–1.96 | 0.01 | Invention example |

EXAMPLE 4

Figure 4:
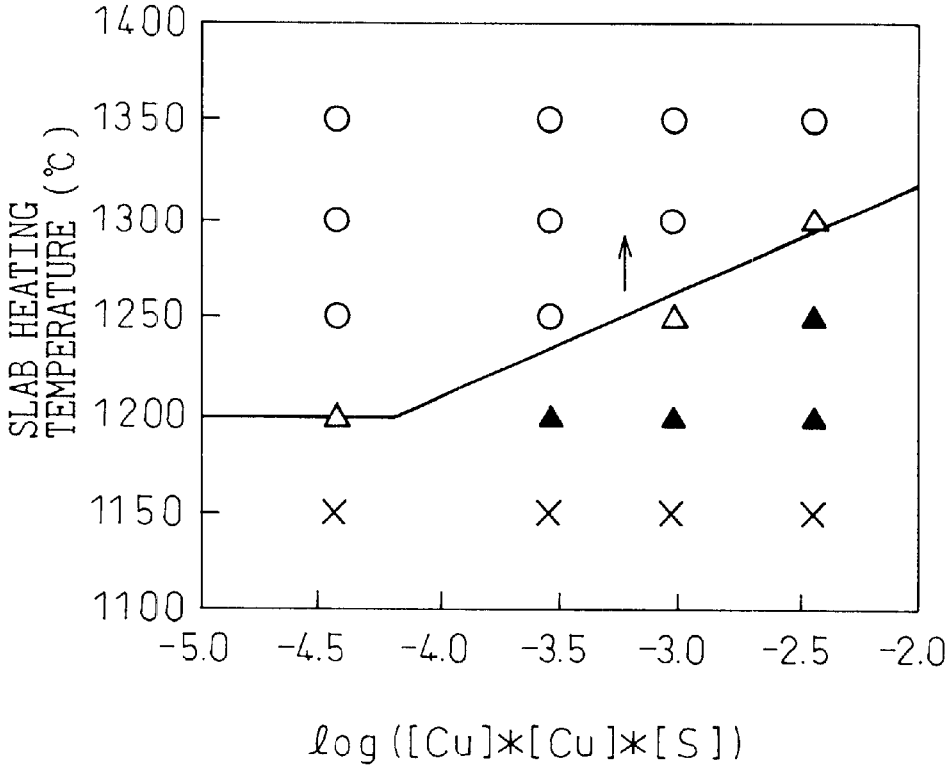
FIG. 4 is a graph showing the relationship between the content of Cu and S, slab heating temperature and the deviation of $B_8$ within a product coil.

Slabs of chemical compositions (13) to (16) shown in Table 7 were manufactured into electrical steel sheets in the following sequential process steps: soaking for 60 min. at one of the five temperatures of example 1; hot rolling into strips of 2.3 mm in thickness; hot strip annealing by holding at 1,120° C. for 250 sec. and then cooling rapidly; pickling; cold rolling to the thickness of 0.35 mm with same aging treatment as Example 1; decarburization annealing by holding at 850° C. for 150 sec.; application of an annealing separator composed mainly of MgO and $TiO_2$ with an addition of MnN to prevent sticking during annealing; final box annealing by heating to 1,200° C. at a heating rate of 10° C./h. and then holding at 1,200° C. for 20 h; and stress relieving annealing. Then, after applying a tension coating mainly composed of colloidal silica and aluminum phosphate to the steel sheets thus produced, their magnetic properties were measured. Table 8 shows the magnetic property measurement results, etc. under the above test conditions and FIG. 4 shows the relationship of the contents of Cu and S and slab heating temperature to the deviation of $B_8$ within a product coil. It can be seen in the tables and the figure that excellent magnetic properties were stably obtained throughout the length of the product coils when they were produced from slabs with the chemical composition according to the present invention and under the process conditions specified in the present invention. [Table 7]

TABLE 7

| | Chemical composition (mass %) | | | | | | | | | | | Temperature (° C.) | | | | |
|---|---|---|---|---|---|---|---|---|---|---|---|---|---|---|---|---|
| No. | C | Si | sAl | N | S | Mn | Cu | B | Sn | P | Cr | $T_1$ | $T_2$ | $T_3$ | $T_4$ | $T_5$ |
| (13) | 0.063 | 3.25 | 0.021 | 0.0035 | 0.015 | 0.03 | 0.05 | 0.0023 | 0.05 | 0.03 | 0.03 | 1195 | 1188 | — | 1187 | 1134 |
| (14) | " | " | " | " | " | " | 0.14 | " | " | " | " | " | " | " | 1233 | " |
| (15) | " | " | " | " | " | " | 0.25 | " | " | " | " | " | " | " | 1260 | " |
| (16) | " | " | " | " | 0.044 | " | 0.29 | " | " | " | " | " | 1259 | " | 1293 | " |

TABLE 8

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 1 | (13) | a | 28.9 | No secondary recrystallization | — | Comparative example |
| 2 | (13) | b | 18.6 | 1.89–1.92 | 0.03 | Invention example |
| 3 | (13) | c | 15.1 | 1.91–1.93 | 0.02 | Invention example |
| 4 | (13) | d | 15.3 | 1.91–1.94 | 0.02 | Invention example |
| 5 | (13) | e | 15.3 | 1.91–1.92 | 0.01 | Invention example |
| 6 | (14) | a | 29.0 | No secondary recrystallization | — | Comparative example |
| 7 | (14) | b | 18.5 | 1.84–1.91 | 0.07 | Comparative example |
| 8 | (14) | c | 15.2 | 1.91–1.93 | 0.02 | Invention example |
| 9 | (14) | d | 15.1 | 1.91–1.93 | 0.02 | Invention example |
| 10 | (14) | e | 15.3 | 1.92–1.94 | 0.02 | Invention example |

TABLE 8-continued

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 11 | (15) | a | 28.6 | No secondary recrystallization | — | Comparative example |
| 12 | (15) | b | 18.4 | 1.80–1.90 | 0.10 | Comparative example |
| 13 | (15) | c | 15.5 | 1.89–1.93 | 0.04 | Comparative example |
| 14 | (15) | d | 13.9 | 1.92–1.94 | 0.02 | Invention example |
| 15 | (15) | e | 13.7 | 1.91–1.92 | 0.01 | Invention example |
| 16 | (16) | a | 28.4 | No secondary recrystallization | — | Comparative example |
| 17 | (16) | b | 18.2 | 1.80–1.92 | 0.12 | Comparative example |
| 18 | (16) | c | 15.2 | 1.84–1.93 | 0.09 | Comparative example |
| 19 | (16) | d | 11.9 | 1.91–1.94 | 0.03 | Invention example |
| 20 | (16) | e | 12.0 | 1.93–1.95 | 0.02 | Invention example |

EXAMPLE 5

Figure 5:
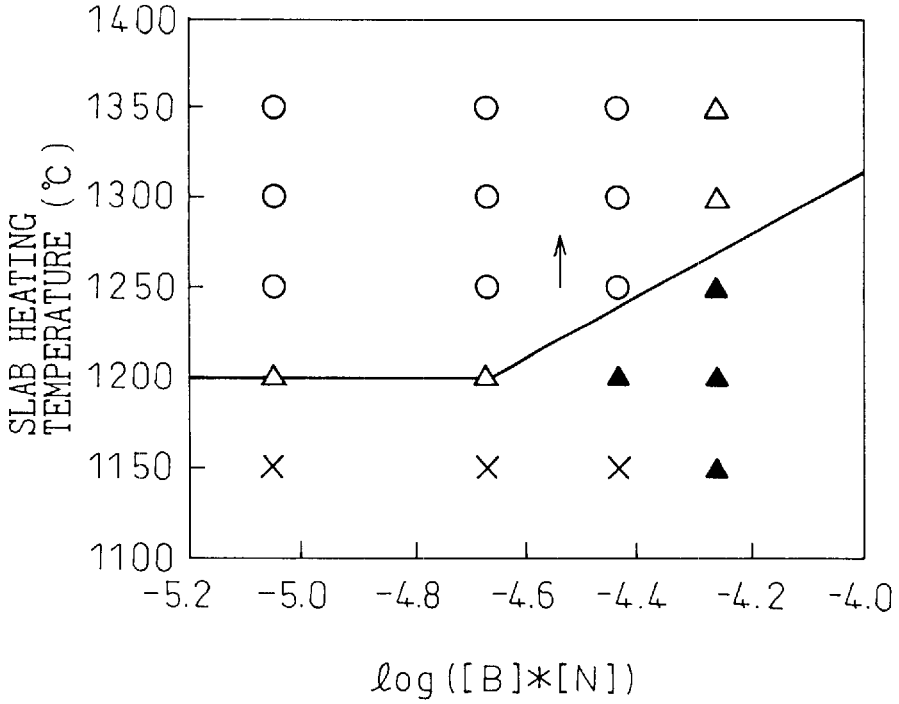
FIG. 5 is a graph showing the relationship between the content of B and N, slab heating temperature and the deviation of $B_8$ within a product coil.

Slabs of chemical compositions (17) to (20) shown in Table 9 were manufactured into electrical steel sheets in the following sequential process steps: soaking for 60 min. at one of the five temperatures of example 1; hot rolling into strips of 2.3 mm in thickness; hot strip annealing by holding at 1,150° C. for 30 sec., holding at 900° C. immediately after that and then cooling rapidly; pickling; cold rolling to a thickness of 0.30 mm with same aging treatment as Example 1; decarburization annealing by holding at 850° C. for 150 sec.; nitriding annealing by holding at 750° C. for 30 sec. in a mixed gas of hydrogen, nitrogen and ammonia to adjust the total nitrogen amount of the steel sheets after the nitriding to 200 ppm or so; application of an annealing separator composed mainly of MgO and $TiO_2$ to prevent sticking during annealing; final box annealing by heating to 1,200° C. at a heating rate of 15° C./h. and then holding at 1,200° C. for 20 h; and stress relieving annealing. Then, after applying a tension coating mainly composed of colloidal silica and aluminum phosphate to the steel sheets thus produced, their magnetic properties were measured. Table 10 shows the magnetic property measurement results, etc. under the above test conditions and FIG. 5 shows the relationship of the contents of B and N and slab heating temperature to the deviation of $B_8$ within a product coil. It can be seen in the tables and the figure that excellent magnetic properties were stably obtained throughout the length of the product coils when they were produced from slabs of the chemical composition according to the present invention and under the process conditions specified in the present invention. It can be seen, however, that the magnetic property deviation within a coil produced from the slab having the highest N concentration is larger than that of the others. [Table 9]

TABLE 9

| | Chemical composition (mass %) | | | | | | | | | | | | Temperature (° C.) | | | | |
|---|---|---|---|---|---|---|---|---|---|---|---|---|---|---|---|---|---|
| No. | C | Si | sAl | N | S | Se | Mn | Cu | B | Sn | Sb | Ni | $T_1$ | $T_2$ | $T_3$ | $T_4$ | $T_5$ |
| (17) | 0.072 | 3.45 | 0.013 | 0.0036 | 0.007 | 0.009 | 0.05 | 0.02 | 0.0025 | 0.10 | 0.02 | 0.06 | 1154 | 1173 | 1172 | 1133 | 1141 |
| (18) | " | " | " | 0.0055 | " | " | " | " | 0.0039 | " | " | " | 1193 | " | " | " | 1198 |
| (19) | " | " | " | 0.0074 | " | " | " | " | 0.0050 | " | " | " | 1221 | " | " | " | 1237 |
| (20) | " | " | " | 0.0089 | " | " | " | " | 0.0062 | " | " | " | 1239 | " | " | " | 1266 |

TABLE 10

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 1 | (17) | a | 22.9 | Partially no secondary recrystallization | — | Comparative example |

TABLE 10-continued

| No. | Chemical composition | Slab heating | Mean grain size at primary recrystallization | Distribution range of $B_8$ within a product coil (T) | $\Delta B_8T$ [Difference between the largest and the smallest of $B_8$ in left column] | Remarks |
|---|---|---|---|---|---|---|
| 2 | (17) | b | 14.8 | 1.92–1.95 | 0.03 | Invention example |
| 3 | (17) | c | 14.7 | 1.92–1.94 | 0.02 | Invention example |
| 4 | (17) | d | 14.7 | 1.92–1.93 | 0.01 | Invention example |
| 5 | (17) | e | 14.8 | 1.93–1.94 | 0.01 | Invention example |
| 6 | (18) | a | 22.1 | Partially no secondary recrystallization | — | Comparative example |
| 7 | (18) | b | 12.0 | 1.92–1.95 | 0.03 | Invention example |
| 8 | (18) | c | 12.1 | 1.94–1.95 | 0.01 | Invention example |
| 9 | (18) | d | 11.9 | 1.92–1.94 | 0.02 | Invention example |
| 10 | (18) | e | 12.0 | 1.93–1.94 | 0.01 | Invention example |
| 11 | (19) | a | 21.0 | Partially no secondary recrystallization | — | Comparative example |
| 12 | (19) | b | 11.3 | 1.83–1.91 | 0.08 | Comparative example |
| 13 | (19) | c | 9.1 | 1.93–1.95 | 0.02 | Invention example |
| 14 | (19) | d | 9.4 | 1.92–1.94 | 0.02 | Invention example |
| 15 | (19) | e | 9.3 | 1.92–1.94 | 0.02 | Invention example |
| 16 | (20) | a | 20.0 | 1.80–1.92 | 0.12 | Comparative example |
| 17 | (20) | b | 10.9 | 1.84–1.93 | 0.09 | Comparative example |
| 18 | (20) | c | 8.3 | 1.89–1.95 | 0.06 | Comparative example |
| 19 | (20) | d | 6.4 | 1.88–1.92 | 0.04 | Comparative example |
| 20 | (20) | e | 6.6 | 1.89–1.92 | 0.03 | Comparative example |

The present invention makes it possible to eliminate the unevenness of secondary recrystallization and to produce a grain-oriented electrical steel sheet, having excellent magnetic properties, industrially and very stably.

The present invention, therefore, largely contributes to the industrial production of a grain-oriented electrical steel sheet.

What is claimed is:

1. A method for producing a grain-oriented electrical steel sheet excellent in magnetic properties, comprising the steps of:

heating a slab containing 0.01 to 0.10 mass % of acid soluble Al (sAl) to a temperature (slab heating temperature Ts (° C.)) lower than 1350° C. and higher than complete solution temperature of substances having capacities as inhibitors;

hot-rolling the heated slab into a hot rolled strip, optionally annealing the hot rolled strip, cold-rolling the hot rolled strip, in one stage or in two or more stages with intermediate annealing(s) to provide a cold rolled sheet;

decarburization annealing the cold rolled sheet;

nitriding treating the decarburization annealed steel sheet before commencement of secondary recrystallization during final box annealing;

final box annealing the decarburization annealed steel sheet after application of an annealing separator to prevent sheet sticking during final box annealing.

2. A method for producing a grain-oriented electrical steel sheet excellent in magnetic properties according to claim 1, characterized by using the slab comprising, in mass %:

0.025 to 0.10% of C, 2.5 to 4.0% of Si, 0.01 to 0.10% of acid-soluble Al (sAl), 0.0075% or less of N, 0.003 to 0.05% of Seq (=S+0.406×Se), and 0.02 to 0.20% of Mn, and the balance Fe and unavoidable impurities, and heating the slab to a slab heating temperature Ts (° C.) higher than any of $T_1$ (° C.), $T_2$ (° C.) and $T_3$ (° C.) defined by the following equations, respectively, where [ ] indicates the mass % of the component element written inside the [ ];

$$T_1=10{,}062/(2.72-\log([sAl]*[N]))-273$$

$$T_2=14{,}855/(6.82-\log([Mn]*[S]))-273$$

$$T_3=10{,}733/(4.08-\log([Mn]*[Se]))-273.$$

3. A method for producing a grain-oriented electrical steel sheet excellent in magnetic properties according to claim 2, characterized by using the slab comprising, additionally, 0.01 to 0.30 mass % of Cu, and heating the slab to a slab heating temperature Ts (° C.) higher than $T_4$ (° C.) defined by the following equation, where [ ] indicates the mass % of the component element written inside the [ ];

$$T_4=43{,}091/(25.09-\log([Cu]*[Cu]*[S]))-273.$$

4. A method for producing a grain-oriented electrical steel sheet excellent in magnetic properties according to claim 2, characterized by using the slab comprising, additionally, 0.0005 to 0.0060 mass % of B, and heating the slab to a slab heating temperature Ts (° C.) higher than $T_5$ (° C.) defined by the following equation, where [ ] indicates the mass % of the component element written inside the [ ];

$$T_5=13{,}680/(4.63-\log([B]*[N]))-273.$$

5. A method for producing a grain-oriented electrical steel sheet excellent in magnetic properties according to claim 1, characterized in that the mean diameter of primary recrystallization grains after the decarburization annealing is 7 $\mu$m or more and below 18 $\mu$m.

6. A method for producing a grain-oriented electrical steel sheet excellent in magnetic properties according to claim 2, characterized by controlling the increment of nitrogen in the steel sheet to 0.001 to 0.03 mass % by applying nitriding treatment to the steel sheet while the steel sheet is running in an atmosphere of a mixed gas of hydrogen, nitrogen and ammonia.

7. A method for producing a grain-oriented electrical steel sheet excellent in magnetic properties according to claim 1, characterized by controlling the cold rolling reduction ratio at the final cold rolling before the decarburization annealing to a range of 80% to 95%.

* * * * *